United States Patent [19]

Shioi et al.

[11] Patent Number: 4,696,317

[45] Date of Patent: Sep. 29, 1987

[54] VANITY CASE

[75] Inventors: Yuji Shioi, Tokyo; Yukitomo Yuhara, Abiko, both of Japan

[73] Assignee: Yoshida Industry Co., Ltd., Tokyo, Japan

[21] Appl. No.: 795,666

[22] Filed: Nov. 6, 1985

[30] Foreign Application Priority Data

May 17, 1985 [JP] Japan ..... 60-72242[U]

[51] Int. Cl.[4] ..... A45D 33/00

[52] U.S. Cl. ..... 132/82 R; 132/82 C

[58] Field of Search ..... 132/79 R, 79 F, 79 G, 132/82 R, 83 R, 83 D

[56] References Cited

U.S. PATENT DOCUMENTS

| | | | |
|---|---|---|---|
| 1,264,555 | 4/1918 | Phillips | 132/82 R |
| 1,497,905 | 6/1924 | Hathaway | 132/82 R |
| 2,031,933 | 2/1936 | Clegg | 132/83 R |
| 2,461,711 | 2/1949 | Wewetzer | 132/79 G |
| 4,580,586 | 4/1986 | Kitoh et al. | 132/83 R |

FOREIGN PATENT DOCUMENTS

| | | | |
|---|---|---|---|
| 479593 | 2/1938 | United Kingdom | 132/79 G |

*Primary Examiner*—Robert P. Swiatek
*Assistant Examiner*—Cary E. Stone
*Attorney, Agent, or Firm*—Wenderoth, Lind & Ponack

[57] ABSTRACT

A vanity case includes a receptacle member having a hollow space for receiving a puff, a cover member hinged with the receptacle member at the respective rear ends thereof, and a tray disposed between the receptacle and cover members and hinged therewith. The tray includes an upper surface having defined thereon a space for containing cosmetic material, and a periphery sandwiched between the receptacle and cover members. The periphery is formed with a recess which communicates the hollow space to the outside of the vanity case to thereby ventilate the hollow space. The puff, after being used in a wet condition, may be quickly dried within the hollow space.

6 Claims, 7 Drawing Figures

VANITY CASE

BACKGROUND OF THE INVENTION

This invention relates to a vanity case for cosmetic material such as makeup.

A typical vanity case comprises a receptacle member for receiving cosmetic material therein and a cover member having a mirror, these parts being hinged together at the respective rear ends thereof. The cosmetic material is usually applied on a face, or other desired portion of a body, by means of a puff which may be received in the receptacle by placing it on the cosmetic material, provided that the puff is always used in a dry condition. Some kinds of cosmetic materials require that the puff be used in a wet condition by impregnating water therein, though the puff must be dried before the next makeup application in order to avoid any sanitary problems. Carrying the puff separately from the vanity case is inconvenient, particularly where the cosmetic material is a recently developed type which permits the puff to be used either in the dry condition or in the wet state.

In view of the above, there has been proposed a vanity case that has a ventilated room or space for receiving a puff therein. A vanity case of this kind is disclosed in, for example, Japanese Utility Model application as laid open under No. 56-131109, wherein a lower cover is provided below a receptacle to define a space for receiving a puff. The lower cover is formed at its bottom with a plurality of apertures through which the space is ventilated. However, the puff normally situated on the bottom tends to close the apertures, resulting in poor ventilation efficiency. Closure of the apertures is also brought on by cosmetic material which remains on the puff after application of the makeup. Further, as the puff is directly exposed to the outer air through the apertures, dust or other undesirable material in the outer air easily adheres to the puff, particularly where it is wet, thus staining the puff.

Japanese Utility Model Publication No. 59-27202 discloses another vanity case having a puff receiving room which is defined within a cover member. The room is ventilated through slits formed at peripheral sides of the cover. Thus, the same problems as in the above described prior art arrangement would arise because the vents or slits are formed in the member defining the puff receiving room.

Accordingly, an object of the present invention is to provide a vanity case having a ventilated room for receiving a puff, wherein the ventilation may be efficiently made to dry the puff as quickly as possible.

Antoher object of the present invention is to provide a vanity case of the type set forth above, in which the puff is prevented from being directly exposed to the outer air and therefore may be kept clean.

SUMMARY OF THE INVENTION

According to the invention, a vanity case comprises a receptacle member having formed therein a hollow space for receiving a puff therein, a cover member hinged with the receptacle member at the respective rear ends thereof, and a tray disposed between the receptacle member and the cover member and hinged therewith. The tray includes an upper surface, a lower surface and a periphery, the upper surface having defined thereon a space for containing cosmetic material therein. The periphery is sandwiched between the receptacle member and the cover member and is formed with a recess which communicates the hollow space to the outside of the vanity case to thereby ventilate the hollow space.

The recess may comprise a concavity formed in the lower surface of the tray and extending between opposite sides of the tray. The lower surface of the tray may separate the space for containing cosmetic material from the hollow space.

Alternatively, the recess may be formed by cutting out the periphery of the tray at opposite sides thereof.

The space for containing cosmetic material is preferably defined by a vertical wall formed on the upper surface of the tray.

Other objects, features and advantages of the present invention will be apparent from the following detailed description of preferred embodiments thereof when taken in conjunction with the accompanying drawings, in which:

DETAILED DESCRIPTION OF THE INVENTION

Figure 1:
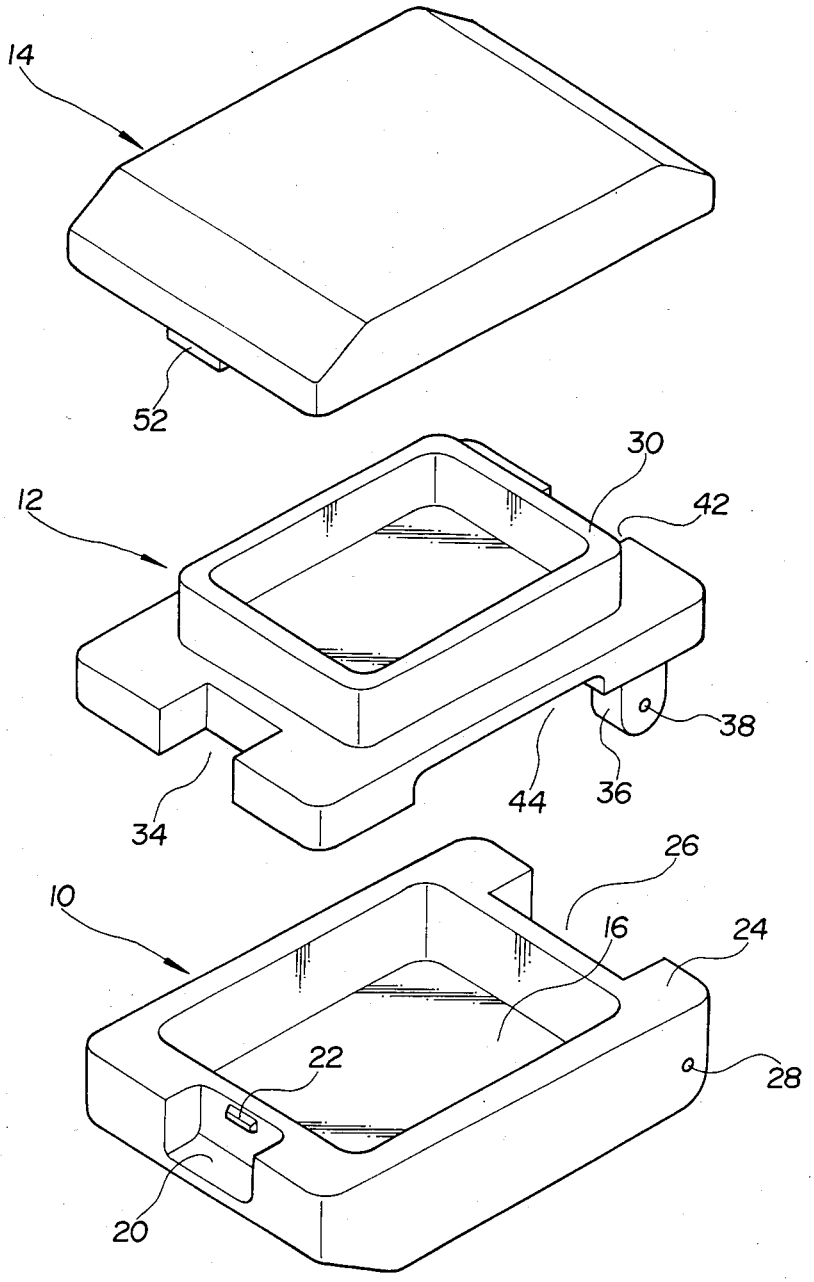
FIG. 1 is an exploded perspective view illustrating a vanity case according to a first embodiment of the invention.

Referring now to FIGS. 1 to 5 of the drawings, a vanity case according to a first embodiment of the present invention generally comprises a receptacle member 10, an inner cover or a tray 12 and a cover member 14. The receptacle 10 has defined therein a hollow space 16 for receiving a puff 18 which is adapted to be used in a wet condition. A recess 20 is formed at the front edge of the receptacle 10 and an end wall defining the recess 20 has a first latch tongue 22 thereon. The rear end of the receptacle 10 includes a pair of extensions 24 to define a hinge space 26 therebetween, each extension 24 having a pin hole 28.

Figure 3:
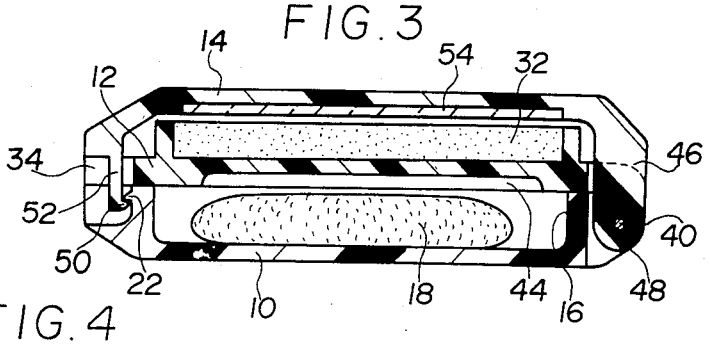
FIG. 3 is a longitudinally sectioned view of the vanity case in FIGS. 1 and 2.
Figure 4:
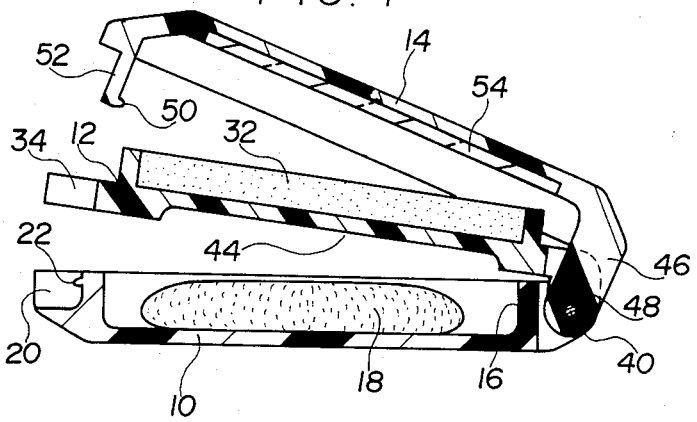
FIG. 4 is a view similar to FIG. 3 showing the vanity case in an open position.
Figure 5:
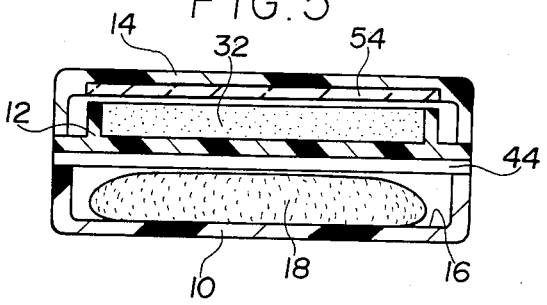
FIG. 5 is a cross sectional view of the vanity case in FIG. 1.

The tray 12 has the same configuration, in plan view, as the receptacle 10 and is so dimensioned that its lower peripheral surface rests on and is in contact with the upper surface of the receptacle 10. A vertical wall 30 is formed on the upper surface of the tray 12 to surround a space which is filled with cosmetic material 32 as shown in FIGS. 3 to 5. The front end of the tray 12 is cut out as at 34 at a position aligned with the recess 20 of the receptacle 10 for permitting engagement between the receptacle 10 and the cover member 14. On the other hand, the rear end of the tray 12 has a pair of downwardly projecting hinge blocks 36 which are spaced from each other and are fitted into the hinge space 26 with apertures 38 in hinge blocks 36 being aligned with the pin holes 28, through which a pin 40 extends to hingedly connect the tray 12 and the receptacle 10 together. Also, the rear end of the tray 12 is recessed at the central portion 42 corresponding to the space between the hinge blocks 36.

The lower side of the tray 12 is concave at 44 by reducing the thickness of the tray, the concavity 44 being illustrated to extend between both sides of the tray. Thus, even when the tray 12 is in a closed position wherein the lower surface thereof rests on the upper surface of the receptacle 10, the hollow space 16 is communicated to the outside of the vanity case for ventilation through the concavity 44, as noted from FIGS. 2 and 5.

Figure 2:
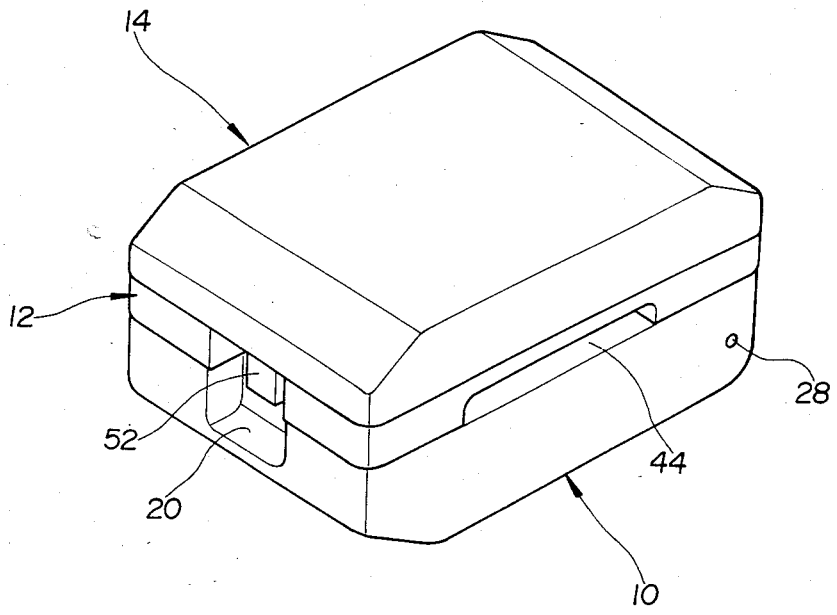
FIG. 2 is a perspective view of the vanity case of FIG. 1 with the parts being assembled together.

The cover member 14 is also dimensioned in conformity with the receptacle 10 and the tray 12 so that the lower peripheral surface of the cover rests on the upper periphery of the tray 12 and that the tray 12 is sandwiched between the receptacle 10 and the cover 14 in a closed position as shown in FIG. 2. A projection 46 having an aperture 48 extends downwardly from the rear end of the cover 14 to fit into the space between the hinge blocks 36 for forming a hinge connection with the tray 12 and the receptacle 10 by the pin 40, whereby the cover 14 and the tray 12 can independently open and close with respect to the receptacle 10 as shown in FIG. 4. For maintaining the cover 14 in the closed position, a second latch tongue 50 engageable with the first one 22 is formed on a nose 52 which projects downwardly from the front end of the cover 14 and which is permitted to enter into the recess 20 of the receptacle 10 through the cut-out 34 of the tray 12. Reference numeral 54 indicates a mirror attached to the lower surface of the cover 14.

When using the cosmetic material 32 contained in the tray 12, the cover 14 is opened to a desired angle after manually releasing the engagement between the latch tongues 22 and 50. The tray 12 is then opened, as shown in FIG. 4, to take up the puff 18 from the receptacle 10. The puff, after being impregnated with water, is used for applying cosmetic material 32. Thereafter, the vanity case is closed in the reverse manner.

In the closed position of the cover 14, the hollow space 16 defined in the receptacle 10 is ventilated through the concavity 44 as described hereinabove. Since the concavity 44 is formed in the tray 12, the vents formed at the opposite sides of the concavity are in no case closed by the puff 18 received in the hollow space 16 and normally resting on the bottom thereof. This ensures that the ventilation is performed efficiently to dry the puff 18 as quickly as possible. The wall defining the hollow space 16 and the lower surface of the tray 12 keep the puff 18 apart from the concavity 44, which prevents the cosmetic material clinging on the puff 18 from sealing the ventilating passages. Further, as the puff 18 is spaced from the vents and is not directly exposed to the outer air, it may be kept clean. The cosmetic material 32 contained within the wall 30 is concealed by the cover 14, and the tray 12 separating the material 32 from the hollow space 16 prevents the material 32 from being moistened.

Figure 7:
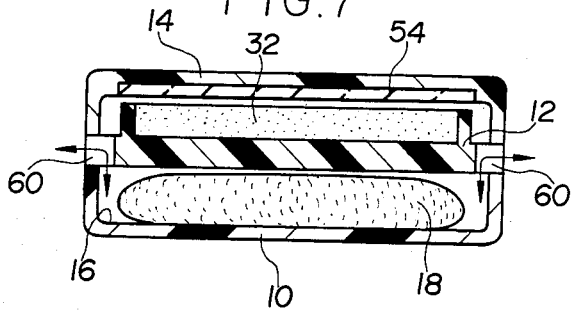
FIG. 7 is a cross sectional view of the vanity case in FIG. 6.
Figure 6:
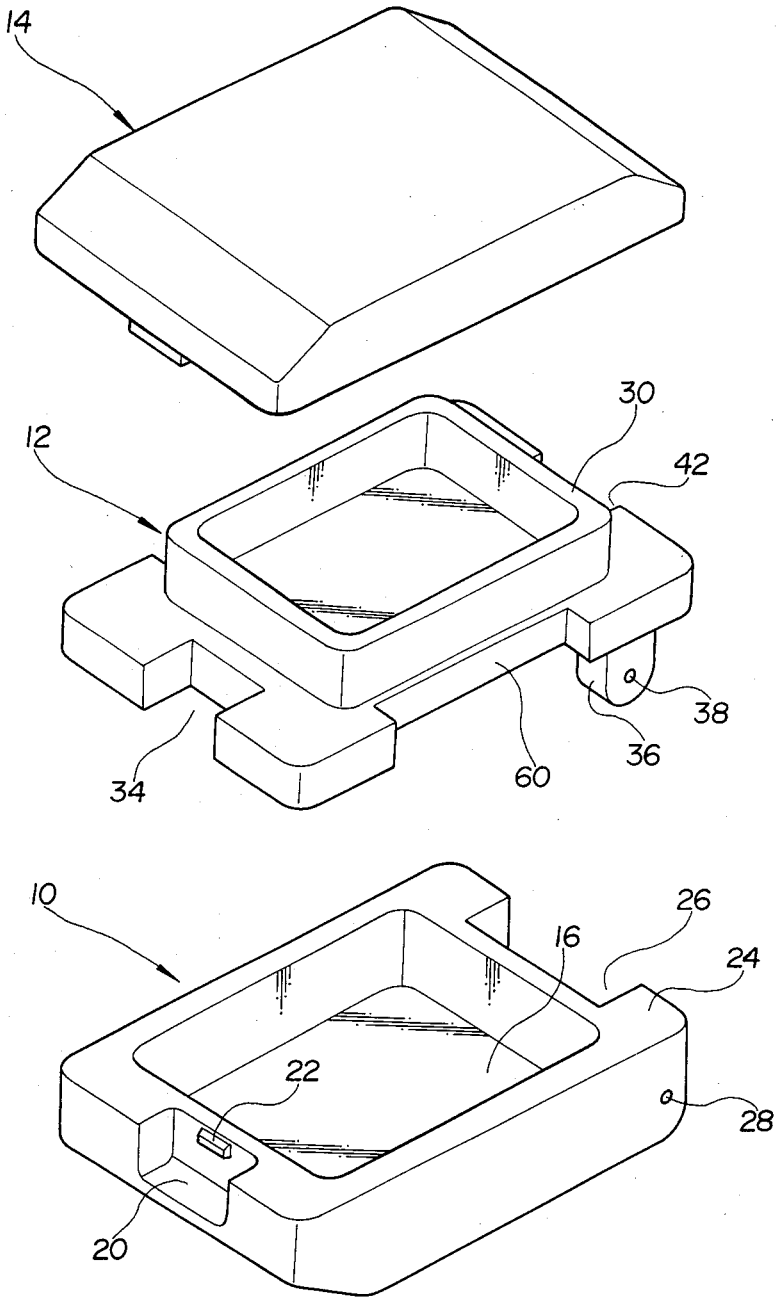
FIG. 6 is an exploded perspective view illustrating a vanity case according to a second embodiment of the invention.

FIGS. 6 and 7 illustrate a vanity case according to a second embodiment of the invention, wherein the same reference numerals are used to indicate the same or corresponding parts. In this embodiment, the tray 12 has a pair of recesses 60 formed at the sides thereof, each recess being formed by rectangularly cutting out the central portion of each side. The recess 60 has a width W larger than the thickness of the wall defining the hollow space 16, so that the recess 60 may ventilate the space 16 as illustrated in FIG. 7. A passage for the air is curved at a substantially right angle, resulting in less invasion of dust from the outer air. If desired, the lower surface of the tray 12 may be concaved to provide a concavity extending between the recesses 60.

In the illustrated embodiments, the hollow space 16 in the receptacle 10 has a depth larger than the thickness of the puff 18 so that the latter is entirely housed within the space 16. If it is desired to further increase the ventilation efficiency, the depth of hollow space 16 may be less than the thickness of the puff so that the upper part of the puff may be situated in a deep concavity formed on the lower surface of tray 12.

Although the present invention has been described with reference to the preferred embodiments thereof, many modifications or alterations may be made within the spirit of the invention.

What is claimed is:

1. A vanity case comprising:

a receptacle member having formed therein a hollow space for receiving therein a puff;

a cover member hinged with said receptacle member at respective rear ends thereof; and a tray disposed between said receptacle member and said cover member and hinged therewith, said tray including an upper surface, a lower surface and a periphery, said upper surface having defined thereon a space for containing therein cosmetic material, said periphery being sandwiched between said receptacle member and said cover member, and said lower surface having formed therein a concavity extending between opposite sides of said tray to define a recess, said recess communicating said hollow space to the outside of said vanity case to thereby ventilate said hollow space.

2. A vanity case as claimed in claim 1, wherein said lower surface of said tray separates said space for containing cosmetic material from said hollow space.

3. A vanity case as claimed in claim 1, wherein said space for containing cosmetic material is defined by a vertical wall formed on said upper surface of said tray.

4. A vanity case comprising:

a receptacle member having formed therein a hollow space for receiving therein a puff;

a cover member hinged with said receptacle member at respective rear ends thereof; and a tray disposed between said receptacle member and said cover member and hinged therewith, said tray including an upper surface, a lower surface and a periphery, said upper surface having defined thereon a space for containing therein cosmetic material, and said periphery being sandwiched between said receptacle member and said cover member and having a recess formed by cutting out said periphery at opposite sides thereof, said recess communicating said hollow space to the outside of said vanity case to thereby ventilate said hollow space.

5. A vanity case as claimed in claim 4, wherein said lower surface of said tray separates said space for containing cosmetic material from said hollow space.

6. A vanity case as claimed in claim 4, wherein said space for containing cosmetic material is defined by a vertical wall formed on said upper surface of said tray.

* * * * *